US005497736A

United States Patent [19]

Miller et al.

[11] Patent Number: 5,497,736

[45] Date of Patent: Mar. 12, 1996

[54] ELECTRIC ACTUATOR FOR ROTARY VALVE CONTROL OF ELECTROHYDRAULIC VALVETRAIN

[75] Inventors: John M. Miller, Saline; Ross M. Stuntz, Birmingham, both of Mich.

[73] Assignee: Ford Motor Company, Dearborn, Mich.

[21] Appl. No.: 369,640

[22] Filed: Jan. 6, 1995

[51] Int. Cl.[6] ..... F01L 9/02

[52] U.S. Cl. ..... 123/90.13; 123/90.15; 123/90.24

[58] Field of Search ..... 123/90.11, 90.12, 123/90.13, 90.15, 90.24

[56] References Cited

U.S. PATENT DOCUMENTS

| | | | |
|---|---|---|---|
| 3,455,209 | 2/1967 | Preston et al. | 91/417 R |
| 3,738,337 | 6/1973 | Massie | 123/90.12 |
| 4,009,694 | 3/1977 | Firey | 123/90.13 |
| 4,106,446 | 8/1978 | Yamada et al. | 123/90.13 |
| 4,200,067 | 4/1980 | Trenne | 123/90.13 |
| 4,446,825 | 5/1984 | Giardini et al. | 123/90.65 |
| 5,058,857 | 10/1991 | Hudson | 251/30.05 |
| 5,193,494 | 3/1993 | Sono et al. | 123/90.12 |
| 5,197,419 | 3/1993 | Dingess | 123/90.13 |
| 5,209,453 | 5/1993 | Aota et al. | 251/57 |
| 5,255,641 | 10/1993 | Schechter | 123/90.11 |
| 5,275,136 | 1/1994 | Schechter et al. | 123/90.12 |
| 5,363,816 | 11/1994 | Yorita et al. | 123/90.13 |
| 5,367,990 | 11/1994 | Schecter | 123/90.12 |
| 5,373,817 | 12/1994 | Schechter et al. | 123/90.12 |
| 5,375,419 | 12/1994 | Wright et al. | 60/607 |

*Primary Examiner*—Weilun Lo

*Attorney, Agent, or Firm*—Donald A. Wilkinson; Roger L. May

[57] ABSTRACT

An engine valve assembly (10) within an electrohydraulic camless valvetrain cooperates with a hydraulic system (9) having a low pressure branch (70) and a high pressure branch (68) to selectively open and close engine valve (12). Engine valve (12) is affixed to a valve piston (16) within a piston chamber (18). A volume (42) below piston (16) is connected to high pressure branch (68) and a volume (20) above piston (16) is selectively connected to the high pressure branch (68) or the low pressure branch (70) via a rotary valve (34), to effect engine valve opening and closing. A four pole, single phase motor (60) effects the movement of the rotary valve (34) and is actuated by a drive circuit (92). Some of the electrical energy spent by drive circuit (92) to accelerate motor (60) is recovered by energy recovery components (102).

13 Claims, 4 Drawing Sheets

ENGINE VALVE LIFT
200
209
210
212
218
θm

SPOOL VALVE STROKE
202
208
214
θm

CRANK ANGLE PULSES
201
1
0
θm 204
1
0
θm 205
1
0
θm 206
1
0
θm 207
1
0
θm 216
1
0
θm

ELECTRIC ACTUATOR FOR ROTARY VALVE CONTROL OF ELECTROHYDRAULIC VALVETRAIN

FIELD OF THE INVENTION

The present invention relates to a system to control intake and exhaust valves in an electrohydraulic camless valvetrain of an internal combustion engine.

This application is related to co-pending application Ser. Nos. 08/369,459; 08/369,460; and 08/369,433, filed herewith; and U.S. Pat. Nos. 5,404,844, 5,410,994, and 5,419,301 herewith.

BACKGROUND OF THE INVENTION

The increased use and reliance on microprocessor control systems for automotive vehicles and increased confidence in hydraulic as opposed to mechanical systems is making substantial progress in engine systems design possible. One such electrohydraulic system is a control for engine intake and exhaust valves. The enhancement of engine performance to be attained by being able to vary the timing, duration, lift and other parameters of the intake and exhaust valves' motion in an engine is known in the art. This allows one to account for various engine operating conditions through independent control of the engine valves in order to optimize engine performance. All this permits considerably greater flexibility in engine valve control than is possible with conventional cam-driven valvetrains.

One such system is disclosed in U.S. Pat. No. 5,255,641 to Schechter (assigned to the assignee of this invention). A system disclosed therein employs a pair of solenoid valves per engine valve, one connected to a high pressure source of fluid and one connected to a low pressure source of fluid. They are used to control engine valve opening and closing. While this arrangement works adequately, the number of solenoid valves required per engine can be large. This is particularly true for multi-valve type engines that may have four or five valves per cylinder and six or eight cylinders. A desire arises, then, to reduce the number of valves needed in order to reduce the cost and complexity of the system. If each pair of solenoid valves is replaced by a single actuator, then the number of valves is cut in half.

This same patent also disclose using rotary distributors to reduce the number of solenoid valves required per engine, but then employs an additional component rotating in relationship to the crankshaft to properly time the rotary distributors. This tie-in to the crankshaft may reduce some of the benefit of a camless valvetrain and, thus, may not be ideal. Further, the system still employs a separate solenoid valve for high pressure and low pressure sources of hydraulic fluid. A desire, then, exists to further reduce the number of valves controlling the high and low pressure sources of fluid from the hydraulic system.

A rotary valve is capable of replacing a pair of solenoid valves to control engine valve lift. An actuator mechanism, then, is required to operate the rotary valve. The actuator must have fast response time and must be small in size and weight to be able to operate at high RPMs at high temperatures; and must have enough torque for starting the engine when cold, when the hydraulic fluid is very viscous and the voltage can be low. This is especially true since the rotary valve body will have tight tolerances to prevent leaking of hydraulic fluid, which creates large friction drag forces.

SUMMARY OF THE INVENTION

In its embodiments, the present invention contemplates an electrohydraulically operated valve control system for an internal combustion engine. The system includes a high pressure hydraulic branch and a low pressure hydraulic branch, having a high pressure source of fluid and a low pressure source of fluid, respectively. A cylinder head member is adapted to be affixed to the engine and includes an enclosed bore and chamber, with an engine valve shiftable between a first and a second position within the cylinder head bore and chamber. A hydraulic actuator has a valve piston coupled to the engine valve and is reciprocable within the enclosed chamber which thereby forms a first and a second cavity which vary in displacement as the engine valve moves. A rotary valve assembly is mounted to the cylinder head member and includes a sleeve and a valve body mounted within the sleeve, with the valve body including at least one high pressure groove and at least one low pressure groove and with the sleeve including three channels and at least one window operatively engaging the third sleeve channel. The cylinder head member includes port means for selectively connecting the high pressure branch and the low pressure branch to the high and low pressure grooves, respectively, and connecting the high and low pressure grooves to the first cavity, with the cylinder head member further including a high pressure line extending between the second cavity and the high pressure branch. The system also includes a motor having a single phase, four poles and means for cooperatively engaging the rotary valve, and an electronic circuit connected to the motor for selectively activating and deactivating the motor in timed relation the engine operation.

Accordingly, an object of the present invention is to provide an electrohydraulic camless valvetrain as disclosed in U.S. Pat. No. 5,255,641 to Schechter that provides an improvement in a camless variable valve control system by incorporating a rotary valve to control the high and low pressure hydraulic fluid supplied to and drawn from a hydraulic engine valve, in which a single phase electric motor is employed to actuate the rotary valve.

An advantage to the present invention is the reduced cost and complexity of the above noted system by eliminating the need for two solenoid valves per engine valve and employing one rotary valve driven by a single phase electric motor that operates over a partial revolution to control an engine valve in a hydraulic system where the motor is small in size and light in weight, yet has a fast response time and sufficient torque for all engine operating conditions. This constitutes an improvement due to more accurate valve control.

A further advantage of the present invention is the recovery of some of the electric energy used to accelerate the motor during rotary valve activation.

DETAILED DESCRIPTION OF THE PREFERRED EMBODIMENTS

Figure 1:
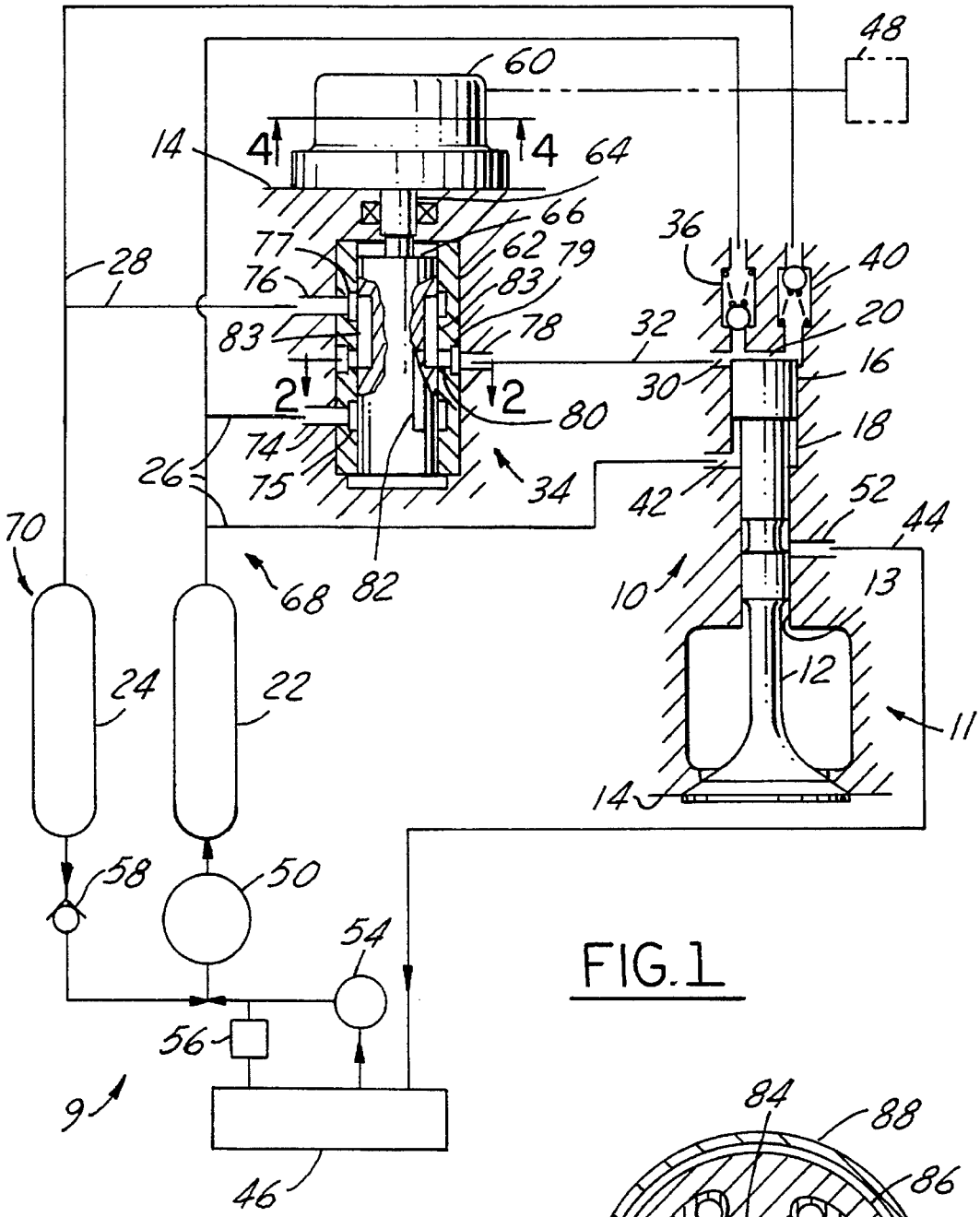
FIG. 1 is a schematic diagram showing a single engine valve, from an engine valvetrain, and an electrohydraulic system for selectively supplying hydraulic fluid to the engine valve.
Figure 4:
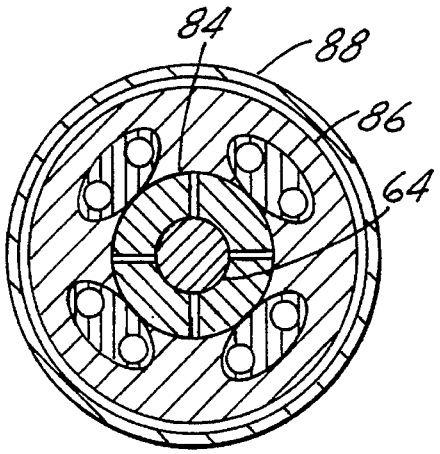
FIG. 4 is a cross-sectional view taken along line 4—4 in FIG. 1, showing the four pole motor with ring magnet rotor on the motor shaft.

A hydraulic system 9, for controlling a valvetrain in an internal combustion engine, connected to a single electrohydraulic engine valve assembly 10 of the electrohydraulic valvetrain, is shown. An electrohydraulic valvetrain is disclosed in U.S. Pat. No. 5,255,641 to Schechter (assigned to the assignee of this invention), which is incorporated herein by reference.

An engine valve 12, for inlet air or exhaust as the case may be, is located within a sleeve 13 in a cylinder head 14, which is a component of engine 11. A valve piston 16, fixed to the top of the engine valve 12, is slidable within the limits of piston chamber 18.

Hydraulic fluid is selectively supplied to a volume 20 above piston 16 through an upper port 30, which is connected to a spool valve 34, via hydraulic line 32. Volume 20 is also selectively connected to a high pressure fluid reservoir 22 through a high pressure check valve 36 via high pressure lines 26, or to a low pressure fluid reservoir 24 via low pressure lines 28 through a low pressure check valve 40. A volume 42 below piston 16 is always connected to high pressure reservoir 22 via high pressure line 26. The pressure surface area above piston 16, in volume 20, is larger than the pressure area below it, in volume 42.

In order to effect the valve opening and closing, a predetermined high pressure must be maintained in high pressure lines 26, and a predetermined low pressure must be maintained in low pressure lines 28. For example, the typical high pressure might be 900 psi and the typical low pressure might be 600 psi. The preferred hydraulic fluid is oil, although other fluids can be used rather than oil.

High pressure lines 26 connect to high pressure fluid reservoir 22 to form a high pressure branch 68 of hydraulic system 9. A high pressure pump 50 supplies pressurized fluid to high pressure branch 68 and charges high pressure reservoir 22. Pump 50 is preferably of the variable displacement variety that automatically adjusts its output to maintain the required pressure in high pressure reservoir 22 regardless of variations in consumption, and may be electrically driven or engine driven.

Low pressure lines 28 connect to low pressure fluid reservoir 24, to form a low pressure branch 70 of hydraulic system 8. A check valve 58 connects to low pressure reservoir 24 and is located to assure that pump 50 is not subjected to pressure fluctuations that occur in low pressure reservoir 24 during engine valve opening and closing. Check valve 58 does not allow fluid to flow into low pressure reservoir 24, and it only allows fluid to flow in the opposite direction when a predetermined amount of fluid pressure has been reached in low pressure reservoir 24. From low pressure reservoir 24, the fluid can return directly to the inlet to pump 50 through check valve 58.

The net flow of fluid from high pressure reservoir 22 through engine valve 12 into low pressure reservoir 24 largely determines the loss of hydraulic energy in system 8. The valvetrain consumes oil from high pressure reservoir 22, and most of it is returned to low pressure reservoir 24. A small additional loss is associated with leakage through the clearance between valve 12 and its sleeve 13. A fluid return line 44, connected to a leak-off passage 52, provides a route for returning any fluid which leaks out to an oil sump 46.

The magnitude of the pressure at the inlet to high pressure pump 50 is determined by a small low pressure pump 54 and its associated pressure regulator 56 which supply a small quantity of oil to the inlet of high pressure pump 50 to compensate for the leakage through leak-off passage 52.

In order to control the supply of the high pressure and low pressure fluid to volume 20 above piston 16, hydraulic rotary valve 34 is employed. It is actuated by an electric motor 60, mounted to cylinder head 14, which controls the linear motion and position of rotary valve 34. A motor shaft 64 rotationally couples motor 60 to a cylindrical rotary valve body 66.

A stationary valve sleeve 62 is mounted in and rotationally fixed relative to cylinder head 14. Valve body 66 is mounted within sleeve 62 and can rotate relative to it. The inner diameter of valve sleeve 62 is substantially the same as the outer diameter of valve body 66, allowing for a small tolerance so they can slip relative to one another.

Cylinder head 14 includes three ports; a high pressure port 74 connected between high pressure line 26 and valve sleeve 62, a low pressure port 76 connected between low pressure line 28 and valve sleeve 62, and a third port 78 leading from valve sleeve 62 to volume 20 above engine valve piston 16 via hydraulic line 32.

Valve sleeve 62 includes two annular channels running about its inner circumference that correspond to the two ports 74 and 76 such that fluid can flow from a port into its corresponding sleeve channel. A high pressure sleeve channel 75 is positioned adjacent to high pressure port 74, and a low pressure sleeve channel 77 is positioned adjacent to low pressure port 76. Valve sleeve 62 also includes a third sleeve channel 79 running about the outer periphery of sleeve 62 that is positioned adjacent to third port 78 such that fluid can flow between the two. A pair of diametrically opposed windows 80 are included in valve sleeve 62, located along the inner circumference of it, and connecting to third sleeve channel 79.

Valve body 66 includes a pair of high pressure grooves 82 and a pair of low pressure grooves 83. High pressure grooves 82 are located opposite one another on the surface of valve body 66 and are positioned such that one end of each is always adjacent to high pressure channel 75 and the other end of each will lie adjacent to a corresponding one of the windows 80 when valve body 66 is in a high pressure open position; see FIG. 2B. Low pressure grooves 83 are located opposite one another and about 4B degrees from corresponding high pressure grooves 82. They are positioned such that one end of each always lies adjacent to low pressure channel 77 and the other end of each will lie adjacent to a corresponding one of the windows 80 when valve body 66 is in a low pressure position; see FIG. 2C.

When valve body 66 is positioned such that no grooves 82 and 83 align with windows 80, which is its closed position, rotary valve 34 keeps third port 78 disconnected from the other two, 74 and 76. Rotating motor 60 until high pressure grooves 82 align with windows 80 connects third port 78 with high pressure port 74. Rotation until low pressure grooves 83 align with windows 80 causes third port 78 to connect with low pressure port 76.

Motor 60 is electrically connected to an engine control system 48, which activates it to determine the timing of engine valve opening and closing. The motor that controls the rotation is a four pole, single phase, rotary motor 60. This is preferred in order to minimize its size and weight. Motor 60 includes a rotor ring magnet 84, coupled to motor shaft 64, and a stator assembly 86, mounted about rotor ring magnet 84. A motor housing 88 encloses them. Ring magnet 84 is shown as a segmented magnet rotor, although a ring magnet rotor can be used instead of the segmented rotor, if so desired.

A single phase and four pole construction constrains rotor ring magnet 84 to rotations of less than about 22 degrees in either direction from center. Motor 60 cannot go an entire revolution, but since this is not needed, it reduces the complexity of the system by eliminating the need for mechanical commutators. Motor 60 also does not need position sensors or an encoder since exactly where it is rotationally does not need to be known. Motor 60 reverses its direction simply by reversing the current sent to it. The use of brushes in motor 60 can now be avoided.

The rotational limitations of rotor 84 determine the relative positions of the high and low pressure grooves 82 and 83 because in about 22 degrees of rotation in either direction from center, valve body 66 must rotate to connect the respective grooves to high or low pressure sleeve channels. Further, minimizing the diameter of rotor 84 to minimize its inertia, while still providing the required magnetics to produce the required torque for accelerating valve body 66, is also desired.

Figure 5:
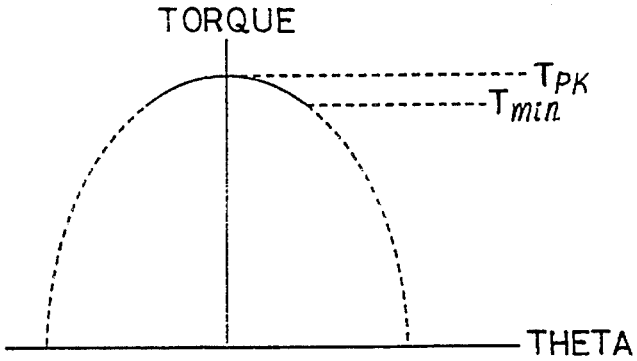
FIG. 5 is a graph of the torque profile of the single phase motor.

FIG. 5 illustrates the torque profile of single phase motor 60. The rotational angle of rotor 84 is constrained to small angles so that sufficient accelerating torque is available; that between $T_{pk}$ and $T_{min}$. The torque diminishes approximately sinusoidally as it rotates off of center.

Figure 6:
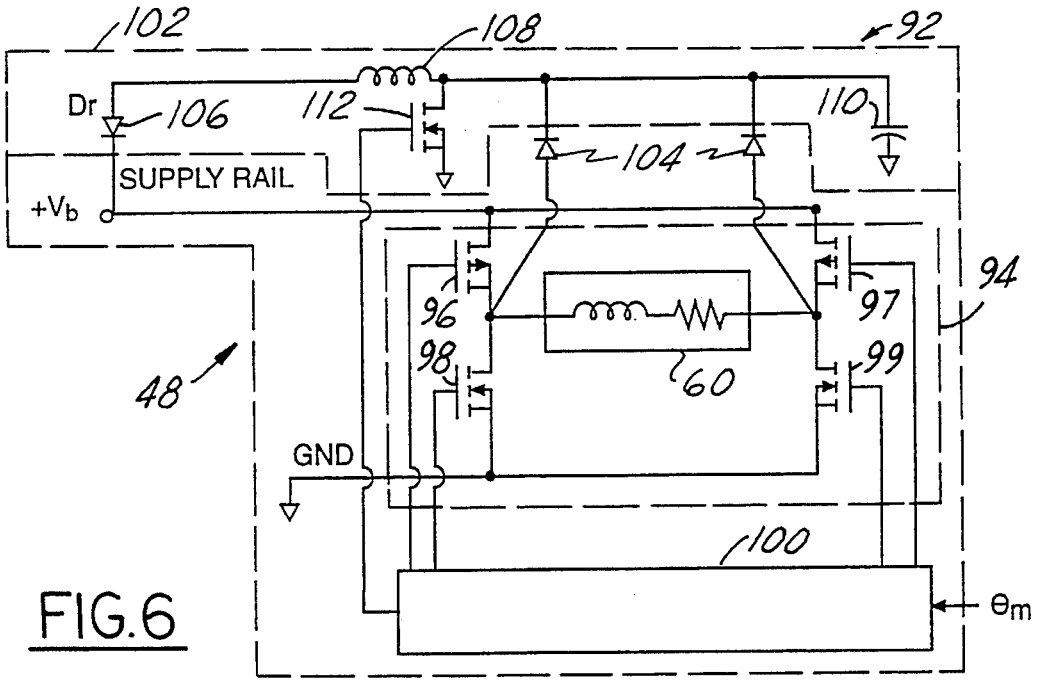
FIG. 6 is a schematic diagram of an electric circuit for controlling the motor.

FIG. 6 shows the drive circuit electronic system 92 that is used to activate motor 60, and for energy recovery. Drive circuit 92 is a bi-directional motor controller in order to rotate valve body 66 in both directions. Circuit 92 is contained in engine control system 48. It includes an H-bridge 94 for four quadrant control. H-bridge 94 includes four transistor switches, two p-channel, 96 and 97, and two n-channel, 98 and 99, connected across motor 60, and connected to a controller 100, which sends timing signals to each of the transistor switches 96–99. Use of n-channel and p-channel MOSFETs are shown, but use of all n-channel and other technologies such as bipolar transistors are also applicable. An input to controller 100 is crankshaft rotational position signal $\theta_m$. H-bridge 94 is connected to energy recovery components 102 through a pair of diodes 104. Energy recovery components 102 include a diode 106, an inductor 108, a capacitor 110 and a transistor switch 112, with transistor switch 112 receiving a timing signal from controller 100.

The relative timing of the process of engine valve opening and closing for this system is graphically illustrated in FIGS. 8A–8H. Engine valve opening is controlled by rotary valve 34 which, when positioned to allow high pressure fluid to flow from high pressure line 26 into volume 20 via hydraulic line 32, causes engine valve opening acceleration, and, when re-positioned such that no fluid can flow between line 26 and line 32, results in engine valve deceleration. Again re-positioning rotary valve 34, allowing hydraulic fluid in volume 20 to flow into low pressure line 28 via hydraulic line 32, causes engine valve closing acceleration, and, when re-positioned such that no fluid can flow between line 28 and 32 results in deceleration.

Figure 2A:
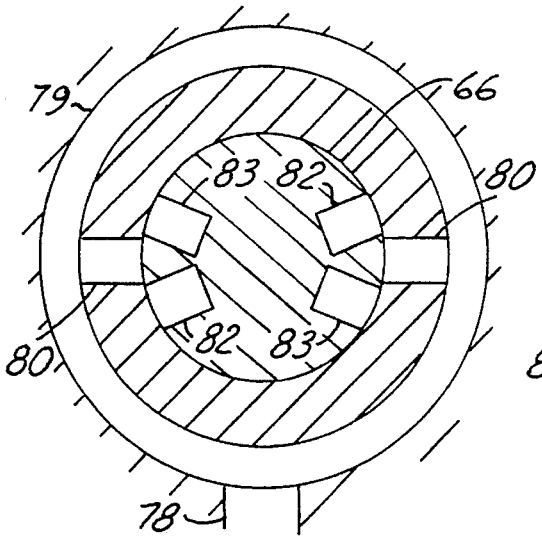
FIGS. 2A–2C are sectional views, on an enlarged scale, taken along line 2—2 in FIG. 1 illustrating various positions of the rotary valve during engine valve operation.
Figure 2B:
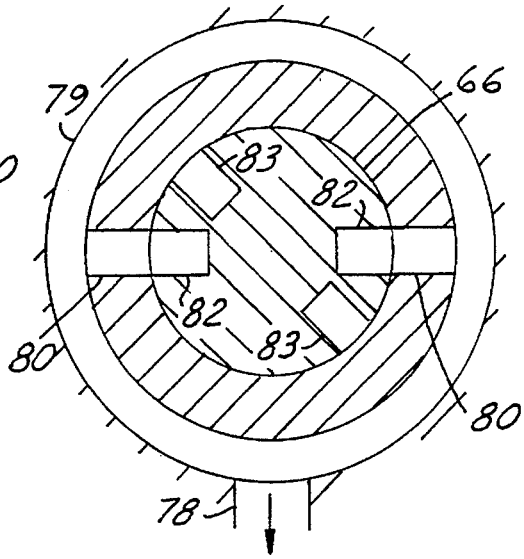

Thus, to initiate engine valve opening, controller 100, within engine control system 48, receives crank angle signals 201 indicating crank angle $\theta_m$. It then sends out signals to transistor switches 96–99; FIGS. 8D–8G indicate the timing of the signals 204–207 sent to transistors 96–99, respectively. These are logic control signals with positive polarity (logic 1 is high level). Motor 60 is activated to rotate rotary valve body 66 so that high pressure grooves 82 align with windows 80, 202 in FIG. 8B, as shown in FIG. 2B. The net pressure force acting on piston 16 accelerates engine valve 12 downward; 200 in FIG. 8A.

Figures 8A, 8B, 8C, 8D, 8E, 8F, 8G, 8H:
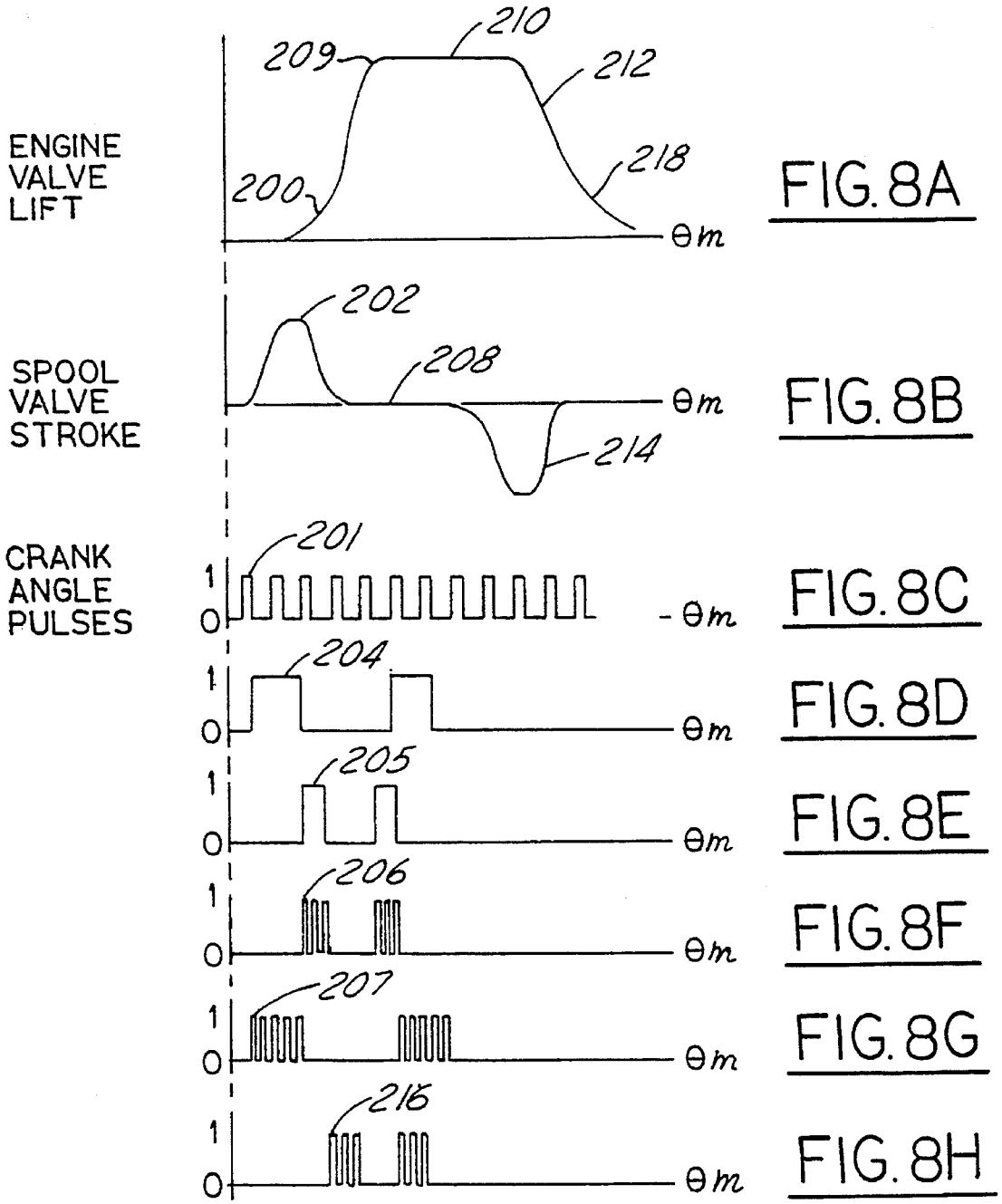
FIGS. 8A–8H are graphical representations showing a typical relative timing between the engine valve lift profile, the spool valve stroke, the crank angle signal, and the control signals to five transistor switches, respectively.

Engine control system 48 then reverses the direction of motor 60, so that motor 60 moves rotary valve body 66 until high pressure grooves 82 no longer align with windows 80, this is the spool valve closed position; 208 in FIG. 8B. The pressure above piston 16 drops, and piston 16 decelerates pushing the fluid from volume 42 below it back through high pressure lines 26; 209 in FIG. 8A. Low pressure check valve 40 opens and fluid flowing through it prevents void formation in volume 20 above piston 16 during deceleration. When the downward motion of engine valve 12 stops, low pressure check valve 40 closes and engine valve 12 remains locked in its open position; 210 in FIG. 8A.

Figure 2C:
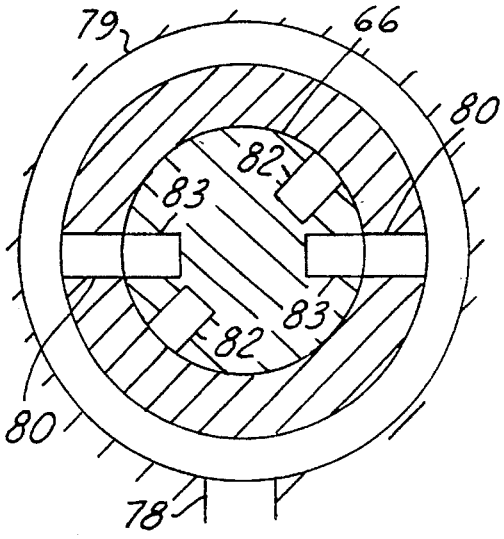

The process of valve closing is similar, in principle, to that of valve opening. Engine control system 48 activates motor 60 to rotate rotary valve body 66 so that low pressure grooves 83 align with windows 80, 214 in FIG. 8B, as shown in FIG. 2C. The pressure above piston 16 drops and the net pressure force acting on piston 16 accelerates engine valve 12 upward; 212 in FIG. 8A. Engine control system 48 then reverses the direction of motor 60, so that it moves rotary valve body 66 until low pressure grooves 83 no longer align with windows 80, the spool valve closed position, as shown in FIG. 2A. The pressure above piston 16 rises, and piston 16 decelerates; 218 in FIG. 8A. High pressure check valve 36 opens as fluid from volume 20 is pushed through it back into high pressure hydraulic line 26 until valve 12 is closed.

Electronic energy recovery components 102 operate by motor activation on engine valve open acceleration and regeneration on deceleration, and on motor activation on engine valve close with regeneration on deceleration. FIG. 8H illustrates the relative timing of a signal 216 sent from controller 100 to switch 112, to effect this energy recovery.

Varying the timing of windows crossings by high and low pressure grooves 82 and 83 varies the timing of the engine valve opening and closing. Valve lift can be controlled by varying the duration of the alignment of high pressure grooves 82 with windows 80. Varying the fluid pressure in high pressure reservoir 22 permits control of engine valve acceleration, velocity and travel time.

During each acceleration of engine valve 12, potential energy of the pressurized fluid is converted into kinetic energy of the moving valve 12 and then, during deceleration, when valve piston 16 pumps the fluid back into high pressure reservoir 22, the kinetic energy is converted back into potential energy of the fluid. Such recuperation of hydraulic energy contributes to reduced energy requirement for the system operation. This adds to the energy recovery that is attained with electric recovery components 102.

Some of the energy used to accelerate motor 60 each activation is recovered during its deceleration to reduce the total electric load required to operate motor 60 as it drives rotary valve body 66.

Figure 3:
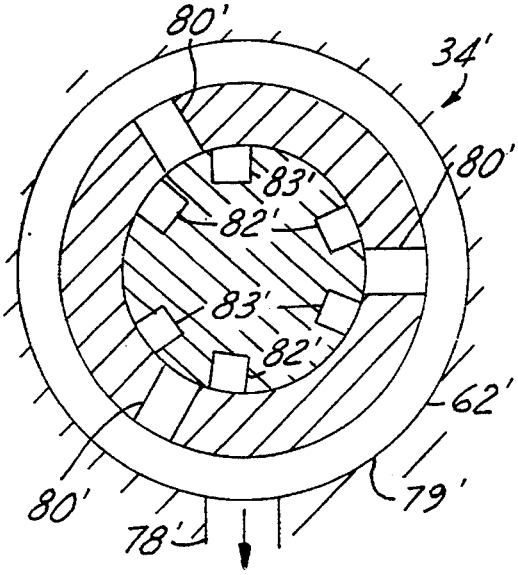
FIG. 3 is a sectional view similar to FIGS. 2A–2C illustrating an alternate embodiment.

An alternate embodiment of the rotary valve of the present invention is illustrated in FIG. 3. For purposes of this description, elements in the FIG. 3 construction that have counterpart elements in the FIG. 1 construction have been identified by similar reference numerals, although a prime is added. It includes three high pressure grooves 82', three low pressure grooves 83' and three windows 80' rather than two of each. Other numbers of groove/window combinations can also be used, although it is desirable to locate the grooves so that the hydraulic pressure forces acting on the rotary valve body 66' are balanced. Furthermore, internal passages can be used in the valve body instead of external grooves.

Figure 7:
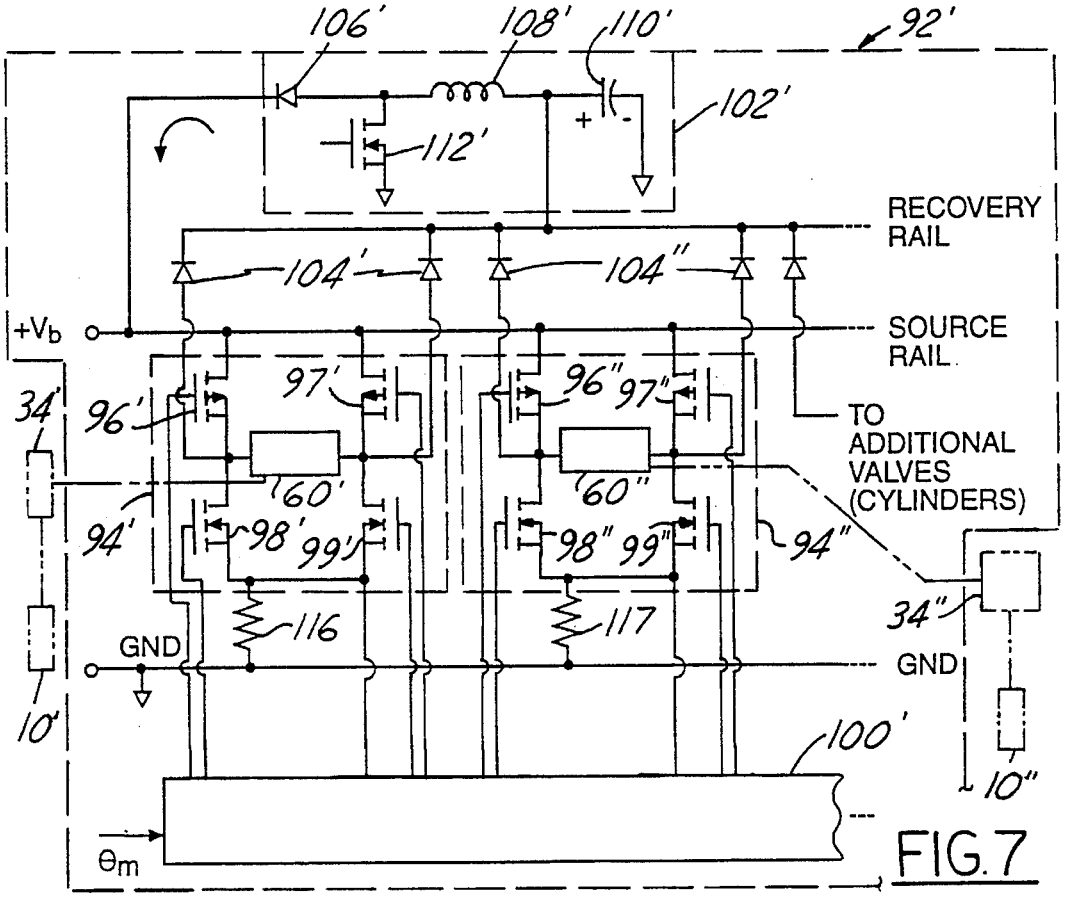
FIG. 7 is a schematic diagram of an electronic circuit, similar to FIG. 6, illustrating an alternate embodiment.

FIG. 7 discloses an alternate embodiment of the drive circuit electronic system 92' that is used to activate multiple motors and to control more than one engine valve at a time. This extends the circuit of FIG. 6, applicable to one engine valve, to multiple circuits with common supply and recovery lines (rails). For purposes of this description, elements in the FIG. 7 constriction that have counterpart element in the FIG. 6 construction have been identified by similar reference numerals, although a prime is added. Additional elements that are similar to elements in the FIG. 6 construction will have a double prime. In this circuit 92', only one set of energy recovery components 102' is required for the multiple motors 60' and 60". Motor 60' is coupled to rotary valve 34' which in turn is coupled to engine while assembly 10', while motor 60" is coupled to rotary valve 34" which in turn is coupled to engine valve assembly 10". It includes an H-bridge 94' and 94" for each motor 60' and 60", respectively, with four switch signals coming from controller 100' to transistor switches 96'–99' and 96"–99", respectively. Diodes 104' and 104" again are connected between H-bridges 94' and 94", respectively, and energy recovery components 102'. Additional resistors 116 and 117 connect each H-bridge 94' and 94", respectively, to ground. The energy recovery circuit has an adjustable voltage level across the energy recovery capacitor. When the voltage is controlled to be low by switch 112, the recovery will slower than when the voltage level is controlled to be a higher level. This is because the stored magnetic energy in the motor is released faster when the voltage is constrained to reach a higher level. That is, motor flux linkage equals volt*seconds.

As a further alternate embodiment, the grooves 82 and 38 on the valve body 66 could be changed to require more rotation for alignment with windows 80, however, the motor design will be required to be two or three phases with the drawback that it would require and encoder and more complex drive electronics than is shown in FIGS. 6 and 7.

While certain embodiments of the present invention have been described in detail, those familiar with the art to which this invention relates will recognize various alternative designs and embodiments for practicing the invention as defined by the following claims.

We claim:

1. An electrohydraulically operated valve control system for an internal combustion engine, the system comprising:

a high pressure hydraulic branch and a low pressure hydraulic branch, having a high pressure source of fluid and a low pressure source of fluid, respectively;

a cylinder head member adapted to be affixed to the engine and including an enclosed bore and chamber;

an engine valve shiftable between a first and a second position within the cylinder head bore and chamber;

a hydraulic actuator having a valve piston coupled to the engine valve and reciprocates within the enclosed chamber which thereby forms a first and a second cavity which vary in volume as the engine valve moves;

a rotary valve assembly mounted to the cylinder head member including a sleeve and a valve body mounted within the sleeve, with the valve body including at least one high pressure groove and at least one low pressure groove and with the sleeve including three channels and at least one window operatively engaging the third sleeve channel;

the cylinder head member including port means for selectively connecting the high pressure branch and the low pressure branch to the high and low pressure grooves, respectively, and connecting the high and low pressure grooves to the first cavity, with the cylinder head member further including a high pressure line extending between the second cavity and the high pressure branch;

a motor having a single phase, four poles and means for cooperatively engaging the rotary valve; and an electronic circuit connected to the motor for selectively activating and deactivating the motor in timed relation to the engine operation.

2. An electrohydraulically operated valve control system according to claim 1 wherein the port means includes three ports, a first port connecting the first sleeve channel to the high pressure branch, a second port connecting the second sleeve channel to the low pressure branch and a third port connecting the third sleeve channel to the first cavity, with the three ports and sleeve channels being oriented such that the valve body can be rotated so that the high pressure groove aligns with the first sleeve channel and the at least one window, neither of the grooves aligns with the at least one window, and the low pressure groove aligns with the second sleeve channel and the at least one window.

3. An electrohydraulically operated valve control system according to claim 2 wherein the at least one high pressure groove is two high pressure grooves, the at least one low pressure groove is two low pressure grooves and the at least one window is two windows, positioned such that the windows will sequentially align with the two high pressure grooves simultaneously and then with the two low pressure grooves simultaneously.

4. An electrohydraulically operated valve control system according to claim 1 wherein the at least one high pressure groove is three high pressure grooves, the at least one low pressure groove is three low pressure grooves and the at least one window is three windows positioned such that the windows will sequentially align with the three high pressure grooves simultaneously and then with the three low pressure grooves simultaneously.

5. An electrohydraulically operated valve control system according to claim 1 wherein the electronic circuit comprises:

an H-bridge, including a set of four transistors electrically connected to the motor; and a controller electrically connected to the four transistors.

6. An electrohydraulically operated valve control system according to claim 5 wherein the electronic circuit further comprises:

an energy recovery circuit, including a recovery diode, a recovery inductor, a recovery capacitor and a recovery transistor electrically connected to one another, with the recovery transistor electrically connected to the controller to receive signals therefrom; and a pair of diodes electrically connected between the H-bridge to the energy recovery circuit.

7. An electrohydraulically operated valve control system according to claim 6 further comprising:

a second enclosed bore and chamber included within the cylinder head;

a second engine valve shiftable between a first and a second position within the second cylinder head bore and chamber;

a second hydraulic actuator having a second valve piston coupled to the second engine valve and reciprocable within the second enclosed chamber which thereby forms a first and a second cavity within the second cylinder head bore and chamber which vary in displacement as the second engine valve moves;

a second rotary valve assembly mounted to the cylinder head member including a second sleeve and a second valve body mounted within the second sleeve, with the second valve body including at least one second high pressure groove and at least one second low pressure groove and with the second sleeve including three channels and at least one window operatively engaging the third sleeve channel of the second sleeve;

the cylinder head member including second port means for selectively connecting the high pressure branch and the low pressure branch to the channel, and connecting the channel to the first cavity in the second bore and chamber, with the cylinder head member further including a high pressure line extending between the second cavity in the second bore and chamber and the high pressure branch;

a second motor having a single phase, four poles and means for cooperatively engaging the second rotary valve;

a second H-bridge, including a second set of four transistors electrically connected to the second motor and electrically connected to the controller;

a second pair of diodes electrically connected between the second H-bridge and the energy recovery circuit; and a first resistor and a second resistor connecting the first H-bridge and the second H-bridge to a ground, respectively.

8. An electrohydraulically operated valve control system according to claim 5 further comprising:

a second enclosed bore and chamber included within the cylinder head;

a second engine valve shiftable between a first and a second position within the second cylinder head bore and chamber;

a second hydraulic actuator having a second valve piston coupled to the second engine valve and reciprocable within the second enclosed chamber which thereby forms a first and a second cavity within the second cylinder head bore and chamber which vary in displacement as the second engine valve moves;

a second rotary valve assembly mounted to the cylinder head member including a second sleeve and a second valve body mounted within the second sleeve, with the second valve body including at least one second high pressure groove and at least one second low pressure groove and with the second sleeve including three channels and at least one window operatively engaging the third sleeve channel of the second sleeve;

the cylinder head member including second port means for selectively connecting the high pressure branch and the low pressure branch to the channel, and connecting the channel to the first cavity in the second bore and chamber, with the cylinder head member further including a high pressure line extending between the second cavity in the second bore and chamber and the high pressure branch;

a second motor having a single phase, four poles and means for cooperatively engaging the second rotary valve; and a second H-bridge, including a second set of four transistors electrically connected to the second motor and electrically connected to the controller.

9. A hydraulically operated valve control system according to claim 1 further including a high pressure check valve mounted between the first cavity and the high pressure source of fluid, and a low pressure check valve mounted between the first cavity and the low pressure source of fluid.

10. A hydraulically operated valve control system according to claim 1 wherein the surface area of the valve piston exposed to the first cavity subjected to fluid pressure is larger than the surface area of the valve piston exposed to the second cavity subjected to fluid pressure.

11. An electrohydraulically operated valve control system for an internal combustion engine, the system comprising:

a high pressure hydraulic branch and a low pressure hydraulic branch, having a high pressure source of fluid and a low pressure source of fluid, respectively;

a cylinder head member adapted to be affixed to the engine and including an enclosed bore and chamber;

an engine valve shiftable between a first and a second position within the cylinder head bore and chamber;

a hydraulic actuator having a valve piston coupled to the engine valve and reciprocates within the enclosed chamber which thereby forms a first and a second cavity which vary in volume as the engine valve moves;

a rotary valve assembly mounted to the cylinder head member including a sleeve and a valve body mounted within the sleeve, with the valve body including two high pressure grooves and two low pressure grooves and with the sleeve including three channels and two windows operatively engaging the third sleeve channel;

the cylinder head member including three ports, a first port connecting the first sleeve channel to the high pressure branch, a second port connecting the second sleeve channel to the low pressure branch and a third port connecting the third sleeve channel to the first cavity, with the three ports and sleeve channels being oriented such that the valve body can be rotated so that the two high pressure grooves align with the first sleeve channel and the two windows, neither of the grooves aligns with the two windows, and the two low pressure grooves align with the second sleeve channel and the two windows, with the cylinder head member further including a high pressure line extending between the second cavity and the high pressure branch;

a motor having a single phase, four poles and means for cooperatively engaging the rotary valve; and an electronic circuit connected to the motor for selectively activating and deactivating the motor in timed relation to the engine operation.

12. An electrohydraulically operated valve control system according to claim 11 wherein the electronic circuit comprises:

an H-bridge, including a set of four transistors electrically connected to the motor; and a controller electrically connected to the four transistors.

13. An electrohydraulically operated valve control system according to claim 12 wherein the electronic circuit further comprises:

an energy recovery circuit, including a recovery diode, a recovery inductor, a recovery capacitor and a recovery transistor electrically connected to one another, with the recovery transistor electrically connected to the controller to receive signals therefrom; and a pair of diodes electrically connected between the H-bridge to the energy recovery circuit.

* * * * *